US007318244B1

(12) United States Patent
Kasatshko

(10) Patent No.: US 7,318,244 B1
(45) Date of Patent: Jan. 15, 2008

(54) FLUID-INFLATABLE PILLOW

(76) Inventor: Victor M. Kasatshko, 1155 Dartford Dr., Tarpon Springs, FL (US) 34688

( * ) Notice: Subject to any disclaimer, the term of this patent is extended or adjusted under 35 U.S.C. 154(b) by 0 days.

(21) Appl. No.: 11/426,067

(22) Filed: Jun. 23, 2006

(51) Int. Cl.
*A47G 9/10* (2006.01)
*A47C 27/10* (2006.01)

(52) U.S. Cl. ..... 5/644; 5/655.3

(58) Field of Classification Search ..... 5/644, 5/654, 655.3, 706, 710, 713, 665, 681, 685–687
See application file for complete search history.

(56) References Cited

U.S. PATENT DOCUMENTS 2,688,142 A * 9/1954 Jensen ..... 5/638
2,843,181 A * 7/1958 Paschen ..... 297/114
2,896,227 A 7/1959 Reed
3,089,153 A * 5/1963 Bosc ..... 5/710
3,112,956 A * 12/1963 Schick et al. ..... 297/219.1
3,253,861 A * 5/1966 Howard ..... 297/452.43
3,602,928 A * 9/1971 Helzer ..... 5/644
3,740,095 A * 6/1973 Nail ..... 297/452.41
3,748,669 A * 7/1973 Warner ..... 5/682
3,864,768 A * 2/1975 Fraige et al. ..... 5/687
4,068,335 A * 1/1978 Phillips ..... 5/687
4,073,021 A * 2/1978 Carlisle ..... 5/654
4,079,473 A * 3/1978 Phillips ..... 5/687
4,136,412 A * 1/1979 Wilhelm ..... 5/417
4,168,555 A * 9/1979 Benjamin ..... 5/682

(Continued)

FOREIGN PATENT DOCUMENTS

FR 2648999 A1 * 1/1991

(Continued)

*Primary Examiner*—Robert G. Santos
(74) *Attorney, Agent, or Firm*—Gordon & Jacobson, PC

(57) ABSTRACT

A pillow for supporting at least one user's head and neck, the pillow having fluid-inflatable first and second chambers disposed about corresponding portions of the perimeter of the pillow. The first chamber has a maximum cross-sectional dimension when inflated that is greater than the maximum cross-sectional dimension of the second chamber when inflated. Preferably, a plurality of fluid-inflatable support chambers extend between the first and second chambers. In one embodiment, the first and second chambers are U-shaped with open ends disposed opposite one another. In another embodiment, the first and second chambers are L-shaped with joined end portions. In yet another embodiment, the first and second chambers extend parallel to one another along opposite sides of the pillow.

13 Claims, 4 Drawing Sheets

U.S. PATENT DOCUMENTS

| | | | | | |
|---|---|---|---|---|---|
| 4,247,963 | A | * | 2/1981 | Reddi | 5/687 |
| 4,310,936 | A | * | 1/1982 | Benjamin | 5/682 |
| D277,917 | S | * | 3/1985 | Slakman | D6/604 |
| 4,558,476 | A | * | 12/1985 | Linder | 5/687 |
| 4,639,960 | A | * | 2/1987 | Quillen et al. | 5/710 |
| 4,685,163 | A | * | 8/1987 | Quillen et al. | 5/710 |
| 4,724,560 | A | * | 2/1988 | Christie | 5/644 |
| 4,829,614 | A | | 5/1989 | Harper | |
| 4,901,386 | A | * | 2/1990 | Lane | 5/687 |
| D308,403 | S | * | 6/1990 | LaForce, Jr. | D21/809 |
| 4,964,183 | A | * | 10/1990 | LaForce, Jr. | 5/421 |
| 5,412,822 | A | * | 5/1995 | Kelly | 5/655.3 |
| 5,555,580 | A | * | 9/1996 | Hsia | 5/665 |
| 5,604,945 | A | * | 2/1997 | Fisher et al. | 5/706 |
| 5,708,999 | A | | 1/1998 | Priolo et al. | |
| 5,771,514 | A | | 6/1998 | Wilhoit | |
| 5,898,963 | A | * | 5/1999 | Larson | 5/644 |
| 6,047,425 | A | * | 4/2000 | Khazaal | 5/644 |
| 6,151,735 | A | | 11/2000 | Koby et al. | |
| 6,397,415 | B1 | * | 6/2002 | Hsieh | 5/644 |
| D476,186 | S | | 6/2003 | Wang et al. | |
| 6,715,171 | B2 | | 4/2004 | Grabe | |
| 7,017,216 | B2 | * | 3/2006 | Hsieh | 5/665 |
| 2005/0050637 | A1 | | 3/2005 | Graebe | |

FOREIGN PATENT DOCUMENTS

| | | | |
|---|---|---|---|
| FR | 2652998 | A2 * | 4/1991 |

* cited by examiner

FLUID-INFLATABLE PILLOW

BACKGROUND OF THE INVENTION

1. Field of the Invention

This invention relates broadly to support pillows and, more particularly, to fluid-inflatable pillows for neck and head support.

2. State of the Art

There are many pillows and similar devices which provide for neck and head support. Heretofore, all of the various products described or invented, although of benefit, have lacked one or more features necessary for comfort and support of the neck and head in many situations.

For example, U.S. Pat. No. 4,829,614 describes a pillow with a series of equal size coplanar inflatable bladders. An additional bladder is disposed over an outside one of the coplanar bladders to provide for neck support. The structure allows for limited control over the firmness of support provided to the user's neck, but it cannot readily be adapted for shared use by individuals with significantly different head and neck sizes.

Thus, there remains a need in the art to provide a support pillow that can readily be adapted for shared use by individuals with significantly different head and neck sizes.

SUMMARY OF THE INVENTION

It is therefore an object of the invention to provide a support pillow that can readily be adapted for shared use by individuals with significantly different head and neck sizes.

It is another object of the invention to provide such a support pillow whose firmness can be widely adjusted as desired by its users.

It is a further object of the invention to provide such a support pillow that can be filled with a fluid such as water or air (water is preferred because of its relatively high heat absorbing capacity and resultant cooling effect to the user).

In accord with these objects, which will be discussed in detail below, a pillow for supporting at least one user's head and neck includes fluid-inflatable first and second chambers disposed about corresponding portions of the perimeter of the pillow. The first chamber has a maximum cross-sectional dimension when inflated that is greater than the maximum cross-sectional dimension of the second chamber when inflated. Preferably, a plurality of fluid-inflatable support chambers extend between the first and second chambers.

It will be appreciated that the first and second chambers provide neck and head support for significantly different head and neck sizes and thus allow the pillow to be readily shared by individuals with significantly different head and neck sizes. The firmness of the chambers can be widely adjusted as desired.

According to one embodiment of the invention, the first and second chambers are U-shaped with open ends disposed opposite one another.

According to a second embodiment of the invention, the first and second chambers are L-shaped with joined end portions.

According to a third embodiment of the invention, the first and second chambers extend parallel to one another along opposite sides of the pillow.

The fluid-inflatable chambers of the pillow may be adapted such that they can be filled with water. Water has a relatively high heat absorbing capacity and thus can provide a cooling effect to the user.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1A:
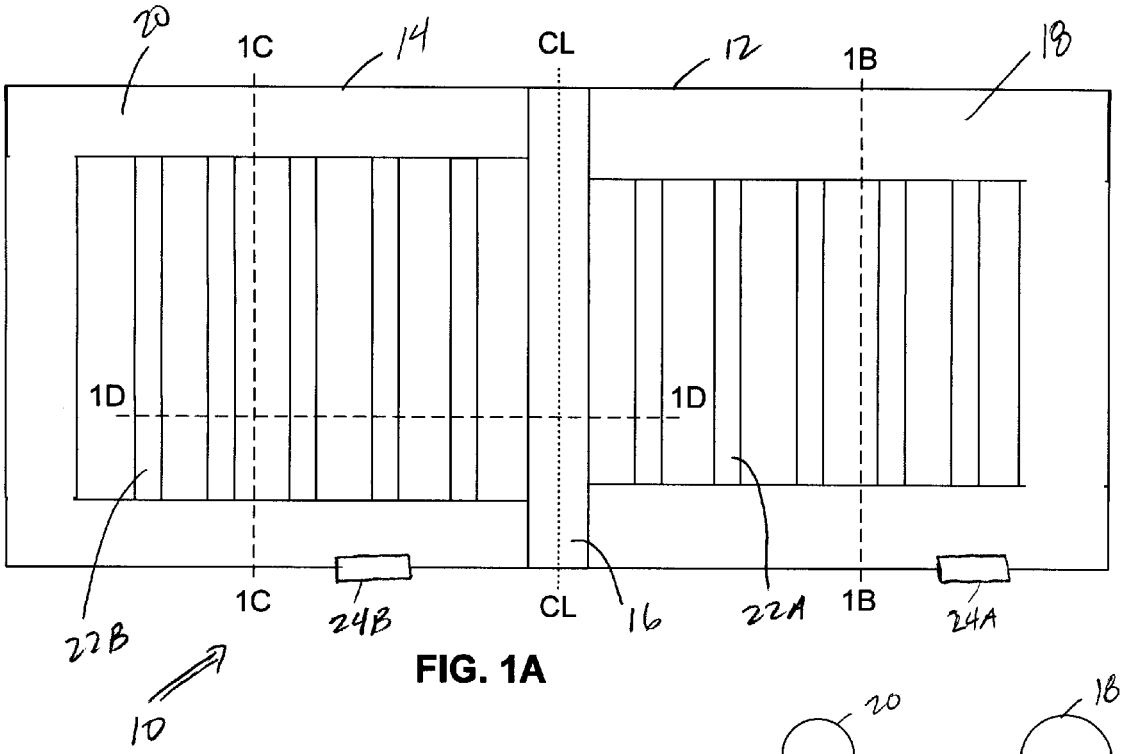
FIG. 1A is a top schematic view of a fluid-inflatable pillow in accordance with the present invention.

Turning now to FIGS. 1A-1D, there is shown a fluid-inflatable pillow 10 embodying the present invention. The pillow 10 includes a first part 12 that is connected to a second part 14 by a flexible hinge 16. The hinge 16 allows the first and second parts 12, 14 to be folded upon another about the centerline CL. The first part 12 includes a U-shaped fluid-inflatable chamber 18 that is disposed about three sides of the perimeter of the first part 12. The second part 14 includes a U-shaped fluid-inflatable chamber 20 that is disposed about three sides of the perimeter of the second part 14. The open ends of the U-shaped chambers 18, 20 are disposed opposite one another adjacent the hinge 16 therebetween.

Figure 1D:
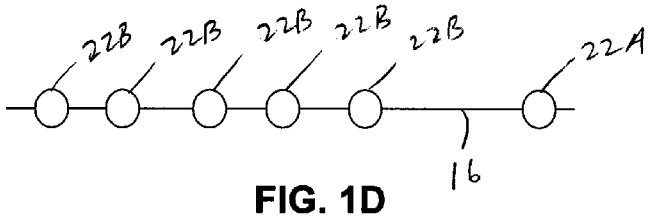
FIG. 1D is a schematic cross-sectional view of the pillow of FIG. 1A along the line 1D-1D.
Figure 1C:
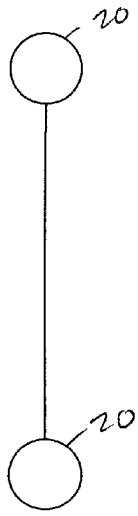
FIG. 1C is a schematic cross-sectional view of the pillow of FIG. 1A along the line 1C-1C.
Figure 1B:
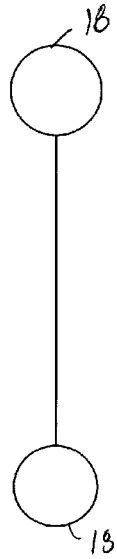
FIG. 1B is a schematic cross-sectional view of the pillow of FIG. 1A along the line 1B-1B.

As best shown in FIGS. 1B and 1C, the chambers 18 and 20 are preferably substantially cylindrical in shape when inflated and thus have an annular cross-sectional shape when inflated, with the inflated diameter of the chamber 18 of the first part 12 significantly larger than the inflated diameter of the chamber 20 of the second part 14. In the preferred embodiment, the inflated diameter of the chamber 18 is on the order of 4 inches, the inflated diameter of the chamber 20 is 3 inches, the pillow 10 has a total width on the order of 36 inches (with the first part 12 and the second part 14 each being on the order of 18 inches wide), and the pillow 10 has a total height on the order of 20 inches.

As shown in FIG. 1A, a first set of support chambers 22A extend transversely between opposing sides of the respective U-shaped chamber 18 and a second set of support chambers 22B extend transversely between opposing sides of the respective U-shaped chamber 20. The number of support chambers 22A, 22B and the relative spacing therebetween can be varied for different applications as needed. As best shown in FIG. 1D, the support chambers 22A, 22B are preferably substantially cylindrical in shape when inflated and thus each has an annular cross-sectional shape when inflated, and the inflated diameters of the chambers 22A, 22B are significantly smaller than the inflated diameters of the chambers 18 and 20. In the preferred embodiment, the inflated diameter of each support chamber 22A, 22B is on the order of 0.5 inches, the support chambers 22A extend transversely on the order of 12 inches between the sides of the chamber 18, and the support chambers 22B extend transversely on the order of 14 inches between the sides of the chamber 20.

In use, fluid (e.g., water or air) is added to the chambers 18, 20, 22A, 22B via one or more inflation ports (for example, two shown as 24A, 24B). After the chambers are inflated, the inflation port(s) are closed to seal the chambers. The use of water in filling the chambers 18, 20, 22A, 22B is advantageous due to its relatively high heat absorbing capacity, which can provide a cooling effect to the user. The large-size chamber 18 can be used to support the neck of a user with a larger neck size, while the small-size chamber 20 can be used to support the neck of a user with a smaller neck size. This allows the pillow to be shared by users with different neck sizes, such as a man whose head and neck are supported by the large size chamber 18 of part 12 and a woman whose head and neck are supported by the small size chamber 20 of part 14. The fluid pressure in the inflated and sealed chambers 18, 20 can be varied by controlling the amount of fluid that fills the respective sealed chambers. If the pressure/firmness is too high, the respective chambers can be deflated by opening up the appropriate inflation port(s) and removing fluid from the chambers as needed. In this manner, the firmness of the neck support provided by the fluid-inflatable chambers 18, 20 can be varied as desired by the individual user(s). Similarly, the fluid pressure in the inflated and sealed support chambers 22A, 22B can be varied by controlling the amount of fluid that fills the respective sealed support chambers. If the pressure/firmness is too high, the support chambers can be deflated by opening up the appropriate inflation port(s) and removing fluid from the support chambers as needed. In this manner, the firmness and support provided by the support chambers 22A, 22B can be varied as desired by the individual user(s). For storage, the chambers 18, 20, 22A, 22B can be deflated by opening up the appropriate inflation port(s) and exhausting all (or most) of the fluid from the chambers of the pillow 10.

As shown in FIG. 1A, the chambers 18, 20 are filled/emptied by separate inflation ports 24A, 24B. In this manner, the two chambers 18, 20 are independently inflatable with respect to one another and can be filled at different pressures for greater control over the neck support provided by the two chambers 18, 20. In an alternate embodiment, the two chambers 18, 20 can be fluidly connected to one another and filled/emptied by a single inflation port. The support chambers 22A are preferably fluidly connected to the chamber 18 and thus filled/emptied by the inflation port 24A. Similarly, the support chambers 22B are preferably fluidly connected to the chamber 20 and thus filled/emptied by the inflation port 24B. Alternatively, the support chambers 22A, 22B can be filled/emptied by dedicated inflation port(s). In another embodiment, two or more different inflation ports can be provided, wherein at least one inflation port is used for air pressurization and at least one other different inflation port is used for filling with water.

In the preferred embodiment, the two parts 12, 14 are formed from a multilayer flexible film of plastic (such as polyvinylchloride or vulcanized latex rubber or rubber canvas or other suitable material) with the chambers 18, 20, 22A, 22B realized by space between the layers of the multilayer film. The chambers are preferably formed by radio frequency (RF) welding, heat welding or other thermal processing techniques that join together the multilayer film about the respective perimeter boundaries of the chambers. The chambers are connected to one another by the multilayer flexible film. The inflation port(s) are affixed to the multilayer film in fluid communication with the respective chambers.

In the preferred embodiment, the two parts 12, 14 are encased by soft padding (e.g., memory foam, regular foam, fiber fill material, feathers, etc.) and the resultant structure covered by a fabric exterior. The inflation port(s) of the two parts is (are) accessible through corresponding window(s) in the padding. The fabric exterior preferably has an opening for removal for cleaning and for exposing the two parts 12, 14 for inflation/deflation of the fluid-inflatable chambers 18, 20, 22A, 22B.

Figure 2A:
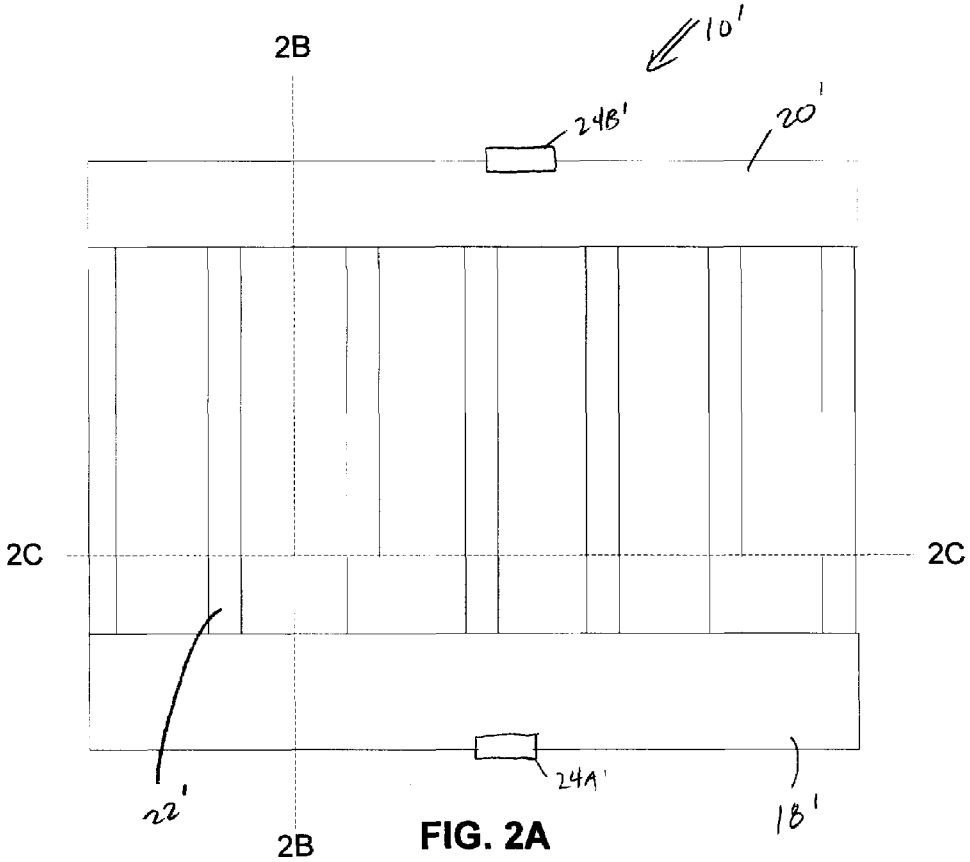
FIG. 2A is a top schematic view of another fluid-inflatable pillow in accordance with the present invention.
Figure 2B:
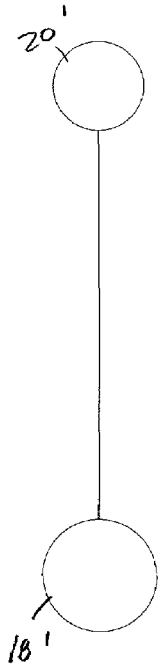
FIG. 2B is a schematic cross-sectional view of the pillow of FIG. 2A along the line 2B-2B.
Figure 2C:
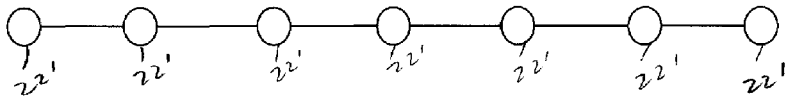
FIG. 2C is a schematic cross-sectional view of the pillow of FIG. 2A along the line 2C-2C.

A second embodiment is shown in FIGS. 2A-2C. In this embodiment, the pillow 10' includes two fluid-inflatable chambers 18', 20' that extend along the length of the pillow 10' in parallel on opposite sides of the perimeter of the pillow 10'. As best shown in FIG. 2B, the chambers 18' and 20' are preferably substantially cylindrical in shape when inflated and thus have an annular cross-sectional shape when inflated, with the inflated diameter of the chamber 18' significantly larger than the inflated diameter of the chamber 20'. In the preferred embodiment, the inflated diameter of the chamber 18' is on the order of 4 inches, the inflated diameter of the chamber 20' is 3 inches, the pillow 10' has a total width on the order of 26 inches, and the pillow 10' has a total height on the order of 20 inches.

As shown in FIG. 2A, a set of support chambers 22' extend transversely between the opposing chambers 18', 20'. The number of support chambers 22' and the relative spacing therebetween can be varied for different applications as needed. As best shown in FIG. 2C, the support chambers 22' are preferably substantially cylindrical in shape when inflated and thus each has an annular cross-sectional shape when inflated, and the inflated diameters of the chambers 22' are significantly smaller than the inflated diameters of the chambers 18' and 20'. In the preferred embodiment, the inflated diameter of each support chamber 22' is on the order of 0.5 inches and the support chambers 22' extend transversely on the order of 13 inches between the chambers 18' and 20'.

In use, fluid (e.g., water or air) is added to the chambers 18', 20', 22' via one or more inflation ports (for example, two shown as 24A', 24B'). After the chambers are inflated, the inflation port(s) are closed to seal the chambers. The use of water in filling the chambers 18', 20', 22' is advantageous due to its relatively high heat absorbing capacity, which can provide a cooling effect to the user. The large-size chamber 18' can be used to support the neck of a user with a large neck size, while the small-size chamber 20' can be used to support the neck of a user with a small neck size. This allows the pillow to be used by users with different neck sizes, such as a man whose head and neck are supported by the large size chamber 18' and a woman whose head and neck are supported by the small size chamber 20'.

The fluid pressure in the inflated and sealed chambers 18', 20' can be varied by controlling the amount of fluid that fills the respective sealed chambers. If the pressure/firmness is too high, the respective chambers can be deflated by opening up the appropriate inflation port(s) and removing fluid from the chambers as needed. In this manner, the firmness of the neck support provided by the fluid-inflatable chambers 18', 20' can be varied as desired by the individual user(s). Similarly, the fluid pressure in the inflated and sealed support chambers 22' can be varied by controlling the amount of fluid that fills the respective sealed support chambers. If the pressure/firmness is too high, the support chambers can be deflated by opening up the appropriate inflation port(s) and removing fluid from the support chambers as needed. In this manner, the firmness and support provided by the support chambers 22' can be varied as desired by the individual user(s). For storage, the chambers 18', 20', 22' can be deflated by opening up the appropriate inflation port(s) and exhausting all (or most) of the fluid from the chambers of the pillow 10'.

As shown in FIG. 2A, the chambers 18', 20' are filled/emptied by separate inflation ports 24A', 24B'. In this manner, the two chambers 18', 20' are independently inflatable with respect to one another and can be filled at different pressures for greater control over the neck support provided by the two chambers 18', 20'. In an alternate embodiment, the two chambers 18', 20' can be fluidly connected to one another and filled/emptied by a single inflation port. The support chambers 22' are preferably fluidly connected to either one (or both) of the chambers 18', 20' and thus filled/emptied by the inflation port 24A', the inflation port 24B' or a common inflation port. Alternatively, the support chambers 22' can be filled/emptied by dedicated inflation port(s). In another embodiment, two or more different inflation ports can be provided, wherein at least one inflation port is used for air pressurization and at least one other different inflation port is used for filling with water.

In the preferred embodiment, the pillow structure 10' is formed from a multilayer flexible film of plastic (such as polyvinylchloride or vulcanized latex rubber or rubber canvas or other suitable material) with the chambers 18', 20', 22' realized by space between the layers of the multilayer film. The chambers are preferably formed by RF welding, heat welding or other thermal processing techniques that join together the multilayer film about the respective perimeter boundaries of the chambers. The chambers are connected to one another by the multilayer flexible film. The inflation port(s) are affixed to the multilayer film in fluid communication with the respective chambers.

In the preferred embodiment, the pillow structure 10' is encased by soft padding (e.g., memory foam, regular foam, fiber fill material, feathers, etc.) and the resultant structure covered by a fabric exterior. The inflation port(s) is (are) accessible through corresponding window(s) in the padding. The fabric exterior preferably has an opening for removal for cleaning and for exposing pillow structure 10' for inflation/deflation of the fluid-inflatable chambers 18', 20', 22'.

Figure 3A:
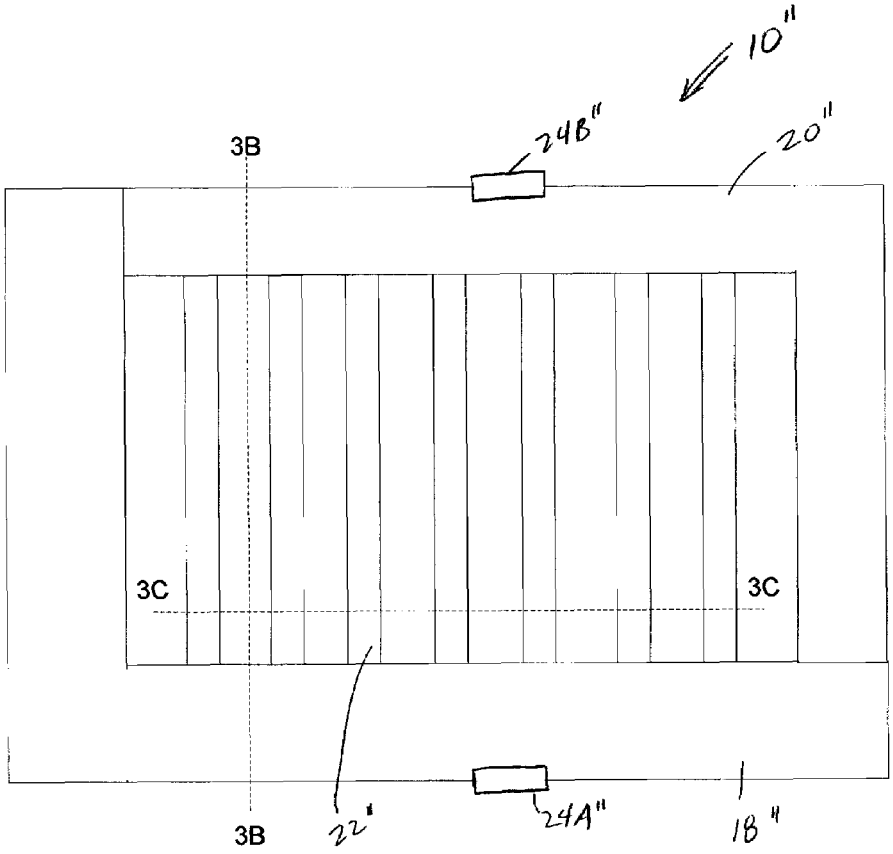
FIG. 3A is a top schematic view of yet another fluid-inflatable pillow in accordance with the present invention.
Figure 3B:
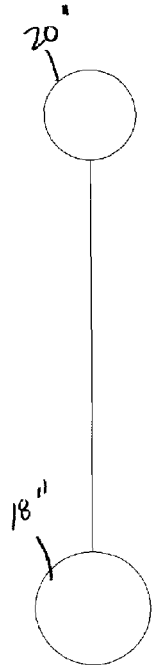
FIG. 3B is a schematic cross-sectional view of the pillow of FIG. 3A along the line 3B-3B.
Figure 3C:
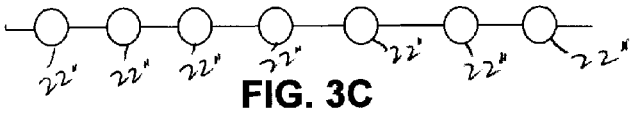
FIG. 3C is a schematic cross-sectional view of the pillow of FIG. 3A along the line 3C-3C.

A third embodiment is shown in FIGS. 3A-3C. In this embodiment, the pillow 10" includes two L-shaped fluid-inflatable chambers 18", 20" that extend along the length of the pillow 10" on opposite sides of the perimeter of the pillow 10". The end portions of the two L-shaped chambers 18", 20" butt up against one another and thus are joined together.

As best shown in FIG. 3B, the chambers 18" and 20" are preferably substantially cylindrical in shape when inflated and thus have an annular cross-sectional shape when inflated, with the inflated diameter of the chamber 18" significantly larger than the inflated diameter of the chamber 20". In the preferred embodiment, the inflated diameter of the chamber 18" is on the order of 4 inches, the inflated diameter of the chamber 20" is 3 inches, the pillow 10" has a total width on the order of 26 inches, and the pillow 10" has a total height on the order of 20 inches.

As shown in FIG. 3A, a set of support chambers 22" extend transversely between the opposing chambers 18", 20". The number of support chambers 22" and the relative spacing therebetween can be varied for different applications as needed. As best shown in FIG. 3C, the support chambers 22" are preferably substantially cylindrical in shape when inflated and thus each has an annular cross-sectional shape when inflated, and the inflated diameter of the chambers 22" is significantly smaller than the inflated diameters of the chambers 18" and 20". In the preferred embodiment, the inflated diameter of each support chamber 22" is on the order of 0.5 inches and the support chambers 22" extend transversely on the order of 13 inches between the long side portions (i.e., the top and bottom side portions) of the chambers 18" and 20".

In use, fluid (e.g., water or air) is added to the chambers 18", 20", 22" via one or more inflation ports (for example, two shown as 24A", 24B"). After the chambers are inflated, the inflation port(s) are closed to seal the chambers. The use of water in filling the chambers 18", 20", 22" is advantageous due to its relatively high heat absorbing capacity, which can provide a cooling effect to the user. The large-size chamber 18" can be used to support the neck of a user with a large neck size, while the small-size chamber 20" can be used to support the neck of a user with a small neck size. This allows the pillow to be used by users with different neck sizes, such as a man whose head and neck are supported by the large size chamber 18" and a woman whose head and neck are supported by the small size chamber 20".

The fluid pressure in the inflated and sealed chambers 18", 20" can be varied by controlling the amount of fluid that fills the respective sealed chambers. If the pressure/firmness is too high, the respective chambers can be deflated by opening up the appropriate inflation port(s) and removing fluid from the chambers as needed. In this manner, the firmness of the neck support provided by the fluid-inflatable chambers 18", 20" can be varied as desired by the individual user(s). Similarly, the fluid pressure in the inflated and sealed support chambers 22" can be varied by controlling the amount of fluid that fills the respective sealed support chambers. If the pressure/firmness is too high, the support chambers can be deflated by opening up the appropriate inflation port(s) and removing fluid from the support chambers as needed. In this manner, the firmness and support provided by the support chambers 22" can be varied as desired by the individual user(s). For storage, the chambers 18", 20", 22" can be deflated by opening up the appropriate inflation port(s) and exhausting all (or most) of the fluid from the chambers of the pillow 10".

As shown in FIG. 3A, the chambers 18", 20" are filled/emptied by separate inflation ports 24A", 24B". In this manner, the two chambers 18", 20" are independently inflatable with respect to one another and can be filled at different pressures for greater control over the neck support provided by the two chambers 18", 20". In an alternate embodiment, the two chambers 18", 20" can be fluidly connected to one another and filled/emptied by a single inflation port. The support chambers 22" are preferably fluidly connected to either one (or both) of the chambers 18", 20" and thus filled/emptied by the inflation port 24A", the inflation port 24B" or a common inflation port. Alternatively, the support chambers 22" can be filled/emptied by dedicated inflation port(s). In another embodiment, two or more different inflation ports can be provided, wherein at least one inflation port is used for air pressurization and at least one other different inflation port is used for filling with water.

In the preferred embodiment, the pillow structure 10" is formed from a multilayer flexible film of plastic (such as polyvinylchloride or vulcanized latex rubber or rubber canvas or other suitable material) with the chambers 18", 20", 22" realized by space between the layers of the multilayer film. The chambers are preferably formed by RF welding, heat welding or other thermal processing techniques that join together the multilayer film about the respective perimeter boundaries of the chambers. The chambers are connected to one another by the multilayer flexible film. The inflation port(s) are affixed to the multilayer film in fluid communication with the respective chambers.

In the preferred embodiment, the pillow structure 10" is encased by soft padding (e.g., memory foam, regular foam, fiber fill material, feathers, etc.) and the resultant structure covered by a fabric exterior. The inflation port(s) is (are) accessible through corresponding window(s) in the padding. The fabric exterior preferably has an opening for removal, cleaning and exposing the pillow structure 10" for inflation/deflation of the fluid-inflatable chambers 18", 20", 22".

Figure 4:
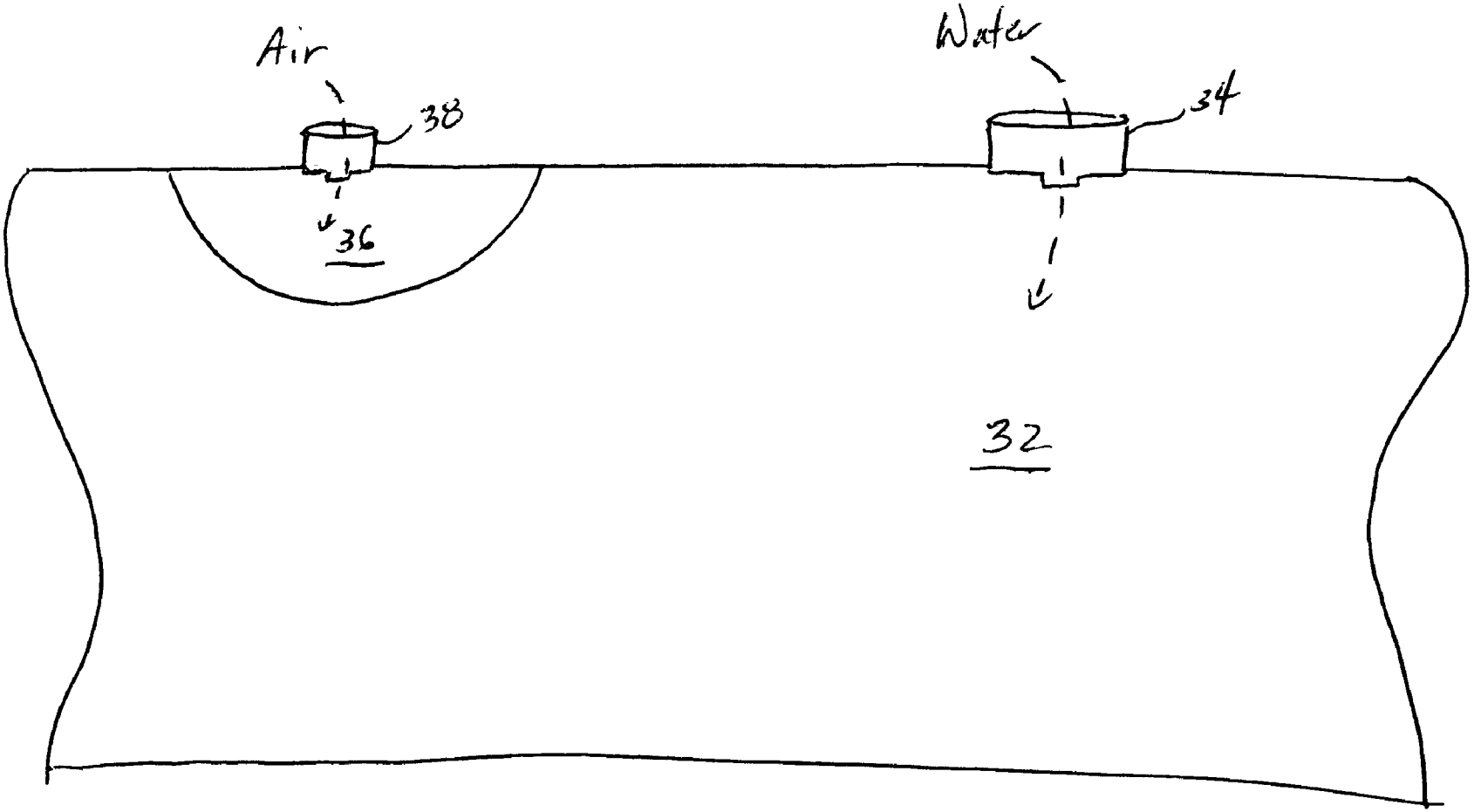
FIG. 4 is a schematic cross-sectional view of a chamber-in-chamber pillow structure in accordance with the present invention.

In an alternate embodiment, any of the fluid-inflatable pillow structures described herein can include a chamber-in-chamber design as shown in FIG. 4, which includes at least one fluid-inflatable chamber 32 together with an inflation port 34 that is used for filling/emptying the fluid-inflatable chamber 32 with water. A flexible air bladder 36 is disposed within the fluid-inflatable chamber 32. An inflation port 38 is provided for inflating/deflating the air bladder 36 with air. The air bladder 36 has a variable volume that is separate and distinct from the volume of the fluid-inflatable chamber 32. In this manner, when the air bladder 36 is inflated with air, it expands and occupies volumetric space within the fluid-inflatable chamber 32.

During use, it is intended that the user will fill the fluid-inflatable chamber 32 with a desired amount of water via inflation port 34. The user will then adjust the firmness of the pillow structure by adding air to (and possibly removing air from) the air bladder 36 via inflation port 34. Preferably, an air pump is operably coupled to the inflation port 38 and operated to inflate the air bladder 36 to the desired air pressure and volume. The inflation port 38 may be opened to allow air to escape for the air bladder 36 in order to reduce its air pressure and volume as desired.

Advantageously, the chamber-in-chamber design of FIG. 4 allows for firmness adjustability by varying air pressure, yet maintains separation between the air of bladder 36 and the water of chamber 32 and thus avoids any gurgling of air that might otherwise result from mixing of water and air in a single pressurized chamber.

There have been described and illustrated herein several embodiments of a pillow for supporting the neck and head of one or more users that can readily be shared by users with different size necks. While particular embodiments of the invention have been described, it is not intended that the invention be limited thereto, as it is intended that the invention be as broad in scope as the art will allow and that the specification be read likewise. Thus, while particular annular chamber shapes have been disclosed, it will be appreciated that other cross-sectional shapes (e.g., oval, elliptical or egg-shaped cross-sections) can be used as well for the fluid-inflatable chambers of the pillow. In addition, while particular types of materials have been disclosed, it will be understood that other materials can be used. Moreover, while particular dimensions and configurations have been disclosed in reference to structural elements of the pillow, it will be appreciated that other dimensions and configurations could be used as well. It will therefore be appreciated by those skilled in the art that yet other modifications could be made to the provided invention without deviating from its spirit and scope as claimed.

What is claimed is:

1. A pillow for supporting at least one user's head and neck comprising:

a fluid-inflatable first chamber extending continuously about a first portion of the perimeter of the pillow, a fluid-inflatable second chamber extending continuously about a second portion of the perimeter of the pillow, both the first and second chambers having a substantially uniform cross-section when inflated, wherein said first chamber has a first cross-sectional dimension when inflated and said second chamber has a second cross-sectional dimension when inflated that is larger than said first cross-sectional dimension to allow the pillow to be shared by users with different neck sizes;

wherein said first and second chambers are U-shaped with open ends disposed opposite one another, and a flexible hinge is disposed adjacent the open ends of the U-shaped first and second chambers, wherein said hinge allows the first and second chambers to be folded onto one another.

2. A pillow according to claim 1, further comprising:

a plurality of fluid-inflatable support chambers that extend from said first and second chambers.

3. A pillow according to claim 2, wherein:

said support chambers are realized from a multilayer flexible plastic film that extends between said first and second chambers.

4. A pillow according to claim 2, wherein:

said support chambers have respective maximum cross-sectional dimensions that are smaller than said first and second cross-sectional dimensions.

5. A pillow according to claim 1, wherein:

said first and second chambers have annular cross-sectional shapes when inflated, wherein diameter of said second chamber is larger than diameter of said first chamber.

6. A pillow according to claim 5, wherein:

the diameter of said second chamber is on the order of 4 inches and the diameter of the first chamber is on the order of 3 inches.

7. A pillow according to claim 1, further comprising:

at least one inflation port for supplying fluid to said first and second chambers.

8. A pillow according to claim 1, wherein:

said first and second chambers are fluidly connected to one another and filled by a single inflation port.

9. A pillow according to claim 1, wherein:

said first and second chambers are independently inflatable with respect to one another and filled by separate inflation ports.

10. A pillow according to claim 1, wherein:

said first and second chambers are adapted to be filled by air during use.

11. A pillow according to claim 1, wherein:

said first and second chambers are adapted to be filled by water during use.

12. A pillow according to claim 1, further comprising:

a first plurality of support chambers that extend between opposite sides of said U-shaped first chamber; and a second plurality of support chambers that extend between opposite sides of said U-shaped second chamber.

13. A pillow according to claim 1, further comprising:

a first inflation port for filling at least one chamber of the pillow;

a flexible air bladder disposed within said at least one chamber; and an inflation port at least for inflating the flexible air bladder with air.

* * * * *